US007105749B2

(12) United States Patent
Belli et al.

(10) Patent No.: US 7,105,749 B2
(45) Date of Patent: Sep. 12, 2006

(54) ELECTRIC CABLE AND MANUFACTURING PROCESS THEREOF

(75) Inventors: Sergio Belli, Leghorn (IT); Alberto Bareggi, Milan (IT); Cristiana Scelza, Angellara Di Vallo Della Lucania (IT)

(73) Assignee: Pirelli & C. S.p.A., Milan (IT)

( * ) Notice: Subject to any disclaimer, the term of this patent is extended or adjusted under 35 U.S.C. 154(b) by 0 days.

(21) Appl. No.: 10/511,204

(22) PCT Filed: Apr. 16, 2002

(86) PCT No.: PCT/EP02/04210

§ 371 (c)(1),
(2), (4) Date: May 10, 2005

(87) PCT Pub. No.: WO03/088274

PCT Pub. Date: Oct. 23, 2003

(65) Prior Publication Data

US 2005/0217891 A1 Oct. 6, 2005

(51) Int. Cl.
*H01B 3/30* (2006.01)

(52) U.S. Cl. ..... 174/110 R; 174/110 F

(58) Field of Classification Search ..... 174/110 R, 174/110 FC, 110 PM, 110 F, 113 R, 120 R, 174/120 SC See application file for complete search history.

(56) References Cited

U.S. PATENT DOCUMENTS

| | | | | |
|---|---|---|---|---|
| 3,013,109 | A | 12/1961 | Gorman et al. | |
| 3,315,025 | A * | 4/1967 | Tomlinson | 174/107 |
| 3,936,591 | A | 2/1976 | Smith et al. | |
| 4,443,657 | A * | 4/1984 | Hill et al. | 174/110 FC |
| 4,468,435 | A * | 8/1984 | Shimba et al. | 428/383 |
| 4,604,497 | A | 8/1986 | Bell et al. | |
| 4,711,811 | A * | 12/1987 | Randa | 428/383 |
| 4,789,589 | A | 12/1988 | Baxter | |
| 5,128,175 | A * | 7/1992 | Yamanishi et al. | 427/515 |
| 5,192,834 | A * | 3/1993 | Yamanishi et al. | 174/120 SR |
| 5,210,377 | A * | 5/1993 | Kennedy et al. | 174/107 |
| 5,574,250 | A * | 11/1996 | Hardie et al. | 174/36 |
| 5,750,931 | A * | 5/1998 | McGregor et al. | 174/110 PM |
| 5,841,072 | A * | 11/1998 | Gagnon | 174/110 F |
| 2003/0079903 | A1 * | 5/2003 | Scheidecker et al. | 174/110 F |

FOREIGN PATENT DOCUMENTS

| | | |
|---|---|---|
| CA | 952991 | 8/1974 |
| EP | 0 271 990 A2 | 6/1998 |
| GB | 2 096 819 A | 10/1982 |
| JP | 09-035544 | 2/1997 |
| JP | 11-203941 | 7/1999 |
| WO | WO 98/52197 | 11/1998 |

OTHER PUBLICATIONS

"PVC Insulated Power Cables, Fire Retardant Single Core Cables with Flexible Conductors Rated Voltage $U_o/U$ : 450/750 V", Italian Standard CEI-UNEL 35752, 2nd Edition (Feb. 1990).

* cited by examiner

*Primary Examiner*—William H. Mayo, III
(74) *Attorney, Agent, or Firm*—Finnegan, Henderson, Farabow, Garrett & Dunner, L.L.P.

(57) ABSTRACT

An electric cable for power transmission at low voltage has at least one conductor and an insulating coating surrounding the at least one conductor. The insulating coating has at least two insulating layers. In a radial direction from the inside toward the outside of the electrical cable, the insulating coating has at least one insulating layer made of a non-expanded polymeric material and at least one insulating layer made of an expanded polymeric material.

32 Claims, 3 Drawing Sheets

ELECTRIC CABLE AND MANUFACTURING PROCESS THEREOF

CROSS REFERENCE TO RELATED APPLICATION

This application is a national phase application based on PCT/EP02/04210, filed Apr. 16, 2002, the content of which is incorporated herein by reference.

BACKGROUND OF THE INVENTION

1. Field of the Invention

The present invention relates to an electric cable with increased flexibility and peeling-off properties.

Moreover, the present invention relates to an electric cable with increased intelligibility of the marked indicia thereon.

In particular, the present invention relates to an electric cable for power transmission at low voltage, preferably said electric cable being suitable for building wiring.

Furthermore, the present invention relates to a manufacturing process of said electric cable.

In the present description, the expression "low voltage" means a voltage of less than about 1 kV, the expression "medium voltage" means a voltage of between about 1 kV and about 30 kV, the expression "high voltage" means a voltage of between about 30 kV and about 220 kV, while the expression "extra high voltage" means a voltage of greater than about 220 kV.

2. Description of the Related Art

Cables for power transmission at low voltage are generally provided with a metallic conductor which is surrounded by an insulating coating adhering to said metallic conductor.

In the present description the expression "cable core" indicates a structure comprising at least one conductor and a respective electric insulating coating arranged in a position radially external to said conductor.

For the purposes of the present description, the expression "unipolar cable" means a cable provided with a single core as defined above, while the expression "multipolar cable" means a cable provided with at least one pair of said cores. In greater detail, when the multipolar cable has a number of cores equal to two, said cable is technically defined as being a "bipolar cable", if there are three cores, said cable is known as a "tripolar cable", and so on.

In a position radially external to said insulating coating, cables for power transmission at low voltage can be provided with an outer polymeric sheath having the function of mechanically protecting the cables from the external environment, e.g. from any impact and/or abrasion that might lead to cable cracks or ruptures formation. In a multipolar type configuration, in the case said outer protective polymeric sheath is present, the multipolar cable is provided with a common sheath surrounding the cable cores as defined above.

Document. U.S. Pat. No. 4,789,589 discloses an electric cable provided with a double layer insulating coating arranged upon a conductive element, said double layer comprising an inner layer of a polyolefin compound and of a cellular construction, and an outer layer of a given maximum thickness and of a non-cured and non-curable polyolefin base compound having a solid (i.e. non-expanded) construction, said base compound including a material compatible with the polyolefin of the inner layer. Preferably, the polyolefin of the outer layer is polyvinyl chloride. Document U.S. Pat. No. 4,789,589 refers to the problem of separation of the thin uncured outer layer from the inner layer during the manufacturing process and/or during installation of the cable. The Applicant observed that such a solution can not correctly work since the inner insulating layer, due to its expanded state, presents discontinuities (i.e., voids within the polymeric material, said voids being filled with air or gas) in the space surrounding the conductor, i.e. in the space where the electrical field is the most relevant.

Data communication cables provided with a double layer insulating coating comprising an inner layer of an expanded polyolefin compound and an outer layer of a non-expanded polyolefin base compound are described in documents CA-952,991 and U.S. Pat. No. 5,841,072.

Document JP 90-35544 discloses an electric low voltage distribution cable comprising a pair of twisted insulated conductors between which a foaming material is arranged. A sheathing material is also provided for covering the twisted cable cores. The foaming and the insulating material can be polyvinyl chloride.

Document U.S. Pat. No. 3,013,109 relates to non-metallic sheathed cables for building wiring comprising a protective sheath made of expanded cellular organic material. According to said document, the insulation is made of a dense solid material (e.g. a dense semi-rigid polyvinyl chloride) while the outer protective sheath is composed essentially of a tough, flexible resinous plastic material such as polyvinyl chloride in expanded cellular form. Furthermore, document U.S. Pat. No. 3,013,109 states that the outer protective sheath is distinct from the insulation and is slippable or slidable thereon with the result that the cable can be readily bent without distortion in the plane of the conductors and, after being deliberately bent at a selected angle, the cable maintains the bent shape indefinitely.

Document JP 11-203941 discloses a method for manufacturing a cable provided with an insulating coating obtained from a resin composition mainly comprising vinyl chloride resin, and with an expanded sheath layer obtained from a composition mainly comprising vinyl chloride resin into which a foaming agent has been compounded.

Document WO 98/52197, in the name of the Applicant, discloses the use of a layer made of expanded polymeric material of a suitable thickness to be applied in a position radially external to the aforesaid cable core. According to said document, the expanded layer confers the cable high resistance to accidental impacts which might be suffered by the latter during the steps of cable transport or laying. Said impacts are very dangerous for the cable since they can cause considerable damage to the cable structure (for example deformation of the insulating layer, detachment of the cable layers) determining, for example, changes in the electrical gradient of the insulating layer with a consequent reduction in its insulating capacity. Said expanded layer is preferably located in a position immediately below the outer polymeric sheath of the cable and, being able of endowing the cable with high impact strength, it makes possible to eliminate any traditional, generally metallic, protective armours. In order to confer the cable the desired impact resistance, the expanded layer is obtained from a polymeric material which, before expansion, has a flexural modulus at room temperature (measured according to ASTM Standard D790) of at least 200 MPa.

Document U.S. Pat. No. 3,936,591 discloses a non metallic-sheathed cable for building wiring comprising a wall of expanded polyvinyl chloride insulation surrounding each cable conductor and a thin-walled tubular jacket of polyvinyl chloride surrounding the totality of insulated conductors, said jacket conferring mechanical protection to the non metallic-sheathed cable.

Generally, a cable for building wiring is installed within the walls of a building and the installation process requires that the cable passes through walls restrictions or, more frequently, that the cable is pulled through conduits, wherein the cable is permanently confined.

In order to be correctly installed with simple and quick operations, a cable for building wiring needs to be particularly flexible so that it can be inserted into the wall passages and/or wall conduits and follow the bends of the installation path without being damaged.

During customer installation, due to the tortuosity of the installation path and to friction during the pulling operation, the cables for building wiring are generally subjected to tearing or scraping against rough edges and/or surfaces.

The Applicant has perceived that an increased flexibility of an electric cable for building wiring can allow to reduce the damages caused by said tearing or scraping actions.

Furthermore, a very important aspect which is required to be satisfied by a cable for building wiring is a simple and quick peeling-off of the cable. In the present description the term "peeling-off of a cable" is used to indicate the removal of all the cable layers which are radially external to the conductor so that it results uncoated and can be electrically connected to a conductor of a further cable or to an electrical apparatus.

The peeling-off property of a cable for building wiring is a widely felt request of the market since the peeling-off of a cable is an operation which is manually performed by the technical staff. For this reason, said operation is required to be easy and quick to be performed by the operator, taking also into account that it is frequently carried out in narrow spaces and rather uncomfortable conditions.

SUMMARY OF THE INVENTION

The Applicant has found that it is possible to improve the flexibility and the peeling-off property of a cable for building wiring by providing the latter with an insulating coating which has an expanded portion. Preferably, said expanded portion of the insulating coating is a circumferentially extended layer.

In particular, the Applicant has found that said expanded insulating layer has to be preferably positioned not adhering to the cable conductor, i.e. not directly contacting the cable conductor. In other words, the Applicant has found to provide the cable with an insulating coating comprising at least two insulating layers so that, in a radial direction from the inside towards the outside of the cable, the insulating coating comprises at least one insulating layer made of a non-expanded polymeric material and at least one insulating layer made of an expanded polymeric material.

The Applicant has found that the presence of said expanded insulating layer in a position radially external to the non-expanded insulating layer is particularly advantageous in respect of the peeling-off property of the cable and the flexibility thereof.

The Applicant has found that the expanded insulating layer exerts on the conductor a ringing force in the radial direction which is lower than the ringing force exterted on the conductor by a non-expanded insulating layer. For this reason, the force to be exterted by the operator to peel off the cable insulating coating is remarkably reduced and the peeling-off property of the cable is favourably increased.

Moreover, by providing the cable with an expanded insulating layer the flexibility of the cable is advantageously increased with favourable results in the installation process thereof.

In a first aspect the present invention relates to an electric cable comprising a conductor and an insulating coating surrounding said conductor, said insulating coating having a predetermined thickness and comprising at least two insulating layers, characterized in that, in a radial direction from the inside towards the outside of said electrical cable, said insulating layers comprise at least one insulating layer made of a non-expanded polymeric material and at least one insulating layer made of an expanded polymeric material, said at least one insulating layer made of a non-expanded polymeric material being integral with said at least one insulating layer made of an expanded polymeric material.

According to the present invention, the predetermined thickness of said insulating coating is such that said insulating coating confers to the cable the electrical insulating features required by the use it is provided for (e.g defined by relevant Standards). In other words, in the case the cable is provided with a sheath radially external to said insulating coating, said sheath does not contribute to obtain said required electrical insulating features, the required values of the latters being guaranteed by the insulating coating of predetermined thickness.

According to the present invention, the thickness of said insulating layer made of a non-expanded polymeric material is at least half of said predetermined thickness of said insulating coating. Preferably, the thickness of said insulating layer made of a non-expanded polymeric material is not lower than 70% of the predetermined thickness of said insulating coating, more preferably the thickness of said insulating layer made of a non-expanded polymeric material is not lower than 85% of the predetermined thickness of said insulating coating.

According to the present invention, the expanded insulating layer is integral with the non-expanded insulating layer so that said layers are bonded together to form the cable insulating coating. In the present description, the term "integral" is used to indicate that a unitary structure was obtained. Therefore, in the present description the expression "the expanded insulating layer is integral with the non-expanded insulating layer" means that "the expanded insulating layer is formed as a unit with the non-expanded insulating layer". In other words, this means that the expanded and non-expanded insulating layers are bonded together and, once produced, they can not be separated without a cutting means or the like, for instance they can not be separated by applying a traction force thereto or by heating.

Processes for obtaining a unitary structure as defined hereinabove, said unitary structure consisting of a first layer and a second layer, can be, for instance: a) a co-extrusion process of said first and second layers; b) the "tandem" technique according to which the extruder of said first layer and the extruder of said second layer are arranged in series. Alternative embodiments of said abovementioned processes can include the step of application of a suitable adhesive layer between said first and second layers, for instance by means of said co-extrusion process or said "tandem" technique. Particularly preferred is the co-extrusion technique so that the expanded insulating layer of the cable insulating coating is co-extruded with the non-expanded insulating layer of said cable insulating coating.

Preferably, the cable according to the present invention is not provided with a sheath layer, unless a mechanical protective layer against accidental impacts or special abrasion resistance during the installation process thereof is required. In the present description, the term "cable sheath layer" is intended to identify a protective outer layer of the cable having the function of protecting the latter from accidental impacts or abrasion. From the foregoing, according to the term mentioned above, the cable sheath layer is not required to provide the cable with specific electrical insulating properties.

Moreover, the Applicant has found that the cable according to the present invention, thanks to the presence of the expanded insulating layer, can be easily and effectively marked. Generally a cable, such as a cable for building wiring, needs to be marked in order to properly identify the cable. Indicia which are generally provided to the external surface of a cable are, for example, the trade name, the name of the manufacturer, the Standard the cable is in accordance with, the production year. Generally, said indicia are provided every 0.5 m-1.0 m of cable length and it is important that the marked letters can be intelligible and simply recognizable by the operator. The Applicant has found that the expanded insulating layer increases the intelligibility of the marked letters. In fact, the presence of said expanded insulating layer allows the marked letters to stand out from the cable surface more clearly with respect to the case in which the expanded layer is not present.

Furthermore, the expanded insulating layer of the cable according to the present invention advantageously decreases the total weight of the cable so that its installation and transportation is easier and its costs can be remarkably reduced.

In a further aspect of the present invention, the cable insulating coating according to the present invention comprises three insulating layers. In a radial direction from the inside towards the outside of the electric cable, said insulating coating comprises: a) an inner insulating layer made of a non-expanded polymeric material; b) an intermediate non continuous insulating layer made of an expanded polymeric material; c) a continuous external insulating layer made of an expanded polymeric material.

In a further aspect of the present invention, the cable insulating coating according to the present invention comprises, in a radial direction from the inside towards the outside of the electric cable: a) an inner insulating layer made of a non-expanded polymeric material; b) an intermediate insulating layer made of an expanded polymeric material; c) an external insulating layer made of a non-expanded polymeric material. Preferably, said inner insulating layer and said external insulating layer are made of the same polymeric material.

The Applicant has found that, even though the expanded insulating layer is an intermediate layer and is not an external insulating layer, the markability of the cable and the peeling-off property thereof are favourably increased by the presence of said expanded layer.

In a further aspect the present invention relates to a process for manufacturing an electric cable comprising a conductor and an insulating coating surrounding said conductor, said insulating coating comprising, in a radial direction from the inside towards the outside of said electrical cable, at least one insulating layer made of a non-expanded polymeric material and at least one insulating layer made of an expanded polymeric material, said process comprising the steps of: a) feeding said at least one conductor to an extruding machine; b) depositing by co-extrusion: a non-expandable polymeric material in a position radially external to said at least one conductor so as to form said at least one insulating layer made of a non-expanded polymeric material; and an expandable polymeric material in a position radially external to said at least one insulating layer made of a non-expanded polymeric material so as to form said at least one insulating layer made of an expanded polymeric material; c) expanding said expandable polymeric material during said step of depositing by co-extrusion.

Further characteristics and advantages will become clearer in the light of the following description of some preferred embodiments of the present invention.

BRIEF DESCRIPTION OF THE DRAWINGS

The following description makes reference to the accompanying drawings, in which.

DETAILED DESCRIPTION OF THE INVENTION

In the following of the present description, the term "expanded polymeric material" means a polymeric material with a predetermined percentage of "free" space inside the material, i.e. a space not occupied by the polymeric material, but by gas or air.

In general, said percentage of free space in an expanded polymer is expressed by the so-called "expansion degree" (G), defined as follows:

$$G=(d_0/d_e-1)*100$$

where $d_0$ denotes the density of the unexpanded polymer and $d_e$ denotes the apparent density measured on the expanded polymer.

The expanded polymeric material of the expanded insulating layer comprises at least one expandable polymer. If necessary said polymer, after expansion, can be crosslinked, as described in the following of the present description.

Said expandable polymer can be selected from the group comprising: polyolefins, copolymers of various olefins, olefins/unsaturated esters copolymers, polyesters, and mixtures thereof. Examples of suitable polymers are: polyethylene (PE), in particular low-density PE (LDPE), medium-density PE (MDPE), high-density PE (HDPE) and linear low-density PE (LLDPE); polypropylene (PP); ethylene-propylene elastomeric copolymers (EPM) or ethylene-propylene-diene terpolymers (EPDM); natural rubber; butyl rubber; ethylene/vinyl ester copolymers, for example ethylene/vinyl acetate (EVA); ethylene/acrylate copolymers; ethylene/α-olefin thermoplastic copolymers; polystyrene; acrylonitrile-butadiene-styrene resins (ABS); halogenated polymers, in particular polyvinyl chloride (PVC); polyurethane (PUR); polyamides; aromatic polyesters; and their copolymers or mechanical blends.

Polyvinyl chloride is particularly preferred.

In the attached figures, similar or identical components have been given the same reference signs.

Figure 1:
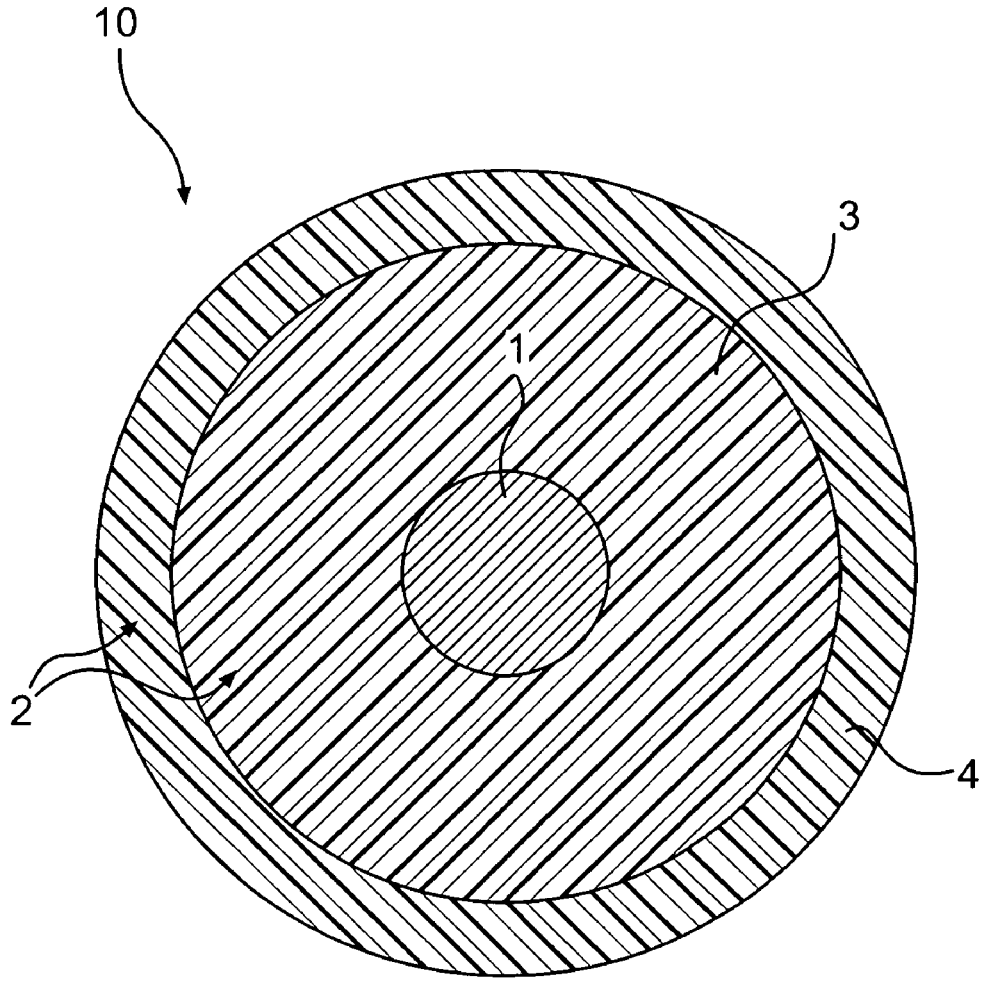
FIG. 1 shows a cross right section of an example of a cable according to the present invention.

FIG. 1 shows the cross section of a first embodiment of a cable 10 for power transmission at low voltage according to the present invention.

Cable 10 is of the unipolar type and comprises a conductor 1 and an insulating coating 2 comprising two insulating layers 3, 4. In details, according to the embodiment shown in FIG. 1, the insulating coating 2 comprises a first inner insulating layer 3 surrounding the conductor 1 and adhering thereto, and a second insulating layer 4 which is coaxial with and external to said inner insulating layer 3. The inner insulating layer 3 is non-expanded while the external insulating layer 4 is made of an expanded polymeric composition having electrical insulating properties, said polymeric composition comprising at least one expandable polymer chosen from the group mentioned above.

The expansion degree of the external expanded insulating layer 4 is generally between 2% and 500%, preferably between 5% and 200%, more preferably between 10% and 50%. As explained in the following of the present description, the expansion of the polymeric base of said external insulating layer 4 is carried out during the extrusion step and can be effected either chemically or physically. An expansion degree between 2% and 100% can be obtained by means of an expansion of the chemical type. On the contrary, an expansion of the physical type can produce a very high expansion degree (i.e., equal to 500%), but it is more expensive than the chemical type. For the purposes of the present invention it is considered to be expanded a layer whose polymeric base has an expansion degree not lower than 2%.

Furthermore, according to the embodiment of FIG. 1, the inner insulating layer 3 is made of a non-expanded polymeric composition having electrical insulating properties, said polymeric composition comprising at least one polymer chosen, for example, from: polyolefins (homopolymers or copolymers of various olefins), ethylenically unsaturated olefin/ester copolymers, polyvinyl chloride (PVC), polyesters, polyethers, polyether/polyester copolymers, and blends thereof. Examples of such polymers are: polyethylene (PE), in particular linear low-density PE (LLDPE); polypropylene (PP); propylene/ethylene thermoplastic copolymers; ethylene/propylene rubbers (EPR) or ethylene/propylene/diene rubbers (EPDM); natural rubbers; butyl rubbers; ethylene/vinyl acetate (EVA) copolymers; ethylene/methyl acrylate (EMA) copolymers; ethylene/ethyl acrylate (EEA) copolymers; ethylene/butyl acrylate (EBA) copolymers; ethylene/α-olefin copolymers, and the like.

Polyvinyl chloride is particularly preferred.

Preferably, the insulating layers 3, 4 of the insulating coating 2 are made of the same base polymer.

Preferably, said base polymer is polyvinyl chloride (PVC).

Except for the expanding agent, preferably the polymeric compositions of the non-expanded insulating layer and of the expanded insulating layer have the same recipe ingredients.

For a conductor of a given cross section, Italian Standard CEI-UNEL 35752 (2nd Edition-February 1990) sets a predetermined average thickness of the insulating coating to be provided to the cable so that, at a predetermined temperature, a minimum electrical resistance of said insulating coating needs to be guaranteed. For example, for a single conductor having a cross section of about 1 $mm^2$, said Italian Standard requires an average thickness of the insulating coating of about 0.7 mm in order to obtain, at 70° C., a minimum electrical resistance of said insulating coating of about 0.095 MOhm*km. For example, for a single conductor having a cross section of about 10 $mm^2$, said Italian Standard requires an average thickness of the insulating coating of about 1.0 mm in order to obtain, at 70° C., a minimum electrical resistance of said insulating coating of about 1.91 MOhm*km.

Therefore, according to the present invention, the minimum average thickness of the insulating coating of an electrical cable is predetermined so that the required electric insulating properties are compatible with the Standards (e.g. Italian Standard CEI-UNEL 35752 or any other Standard equivalent thereto) and are satisfied by said insulating coating.

For instance, the predetermined thickness of the insulating coating is such that, at 70° C., the minimum value of the electric resistance of said insulating coating is greater than 0.024 MOhm*km.

For instance, the minimum average thickness of the insulating coating of the electrical cable is not greater than 2.5 mm.

Furthermore, according to the present invention, the insulating constant $k_i$ of the electrical insulating layers 3, 4 is such that the required electric insulating properties are compatible with the Standards (e.g. Italian Standard CEI 20-11 or other equivalent Standards). For instance, the electrical insulating layers 3, 4 have an insulating constant $k_i$ greater than 750 MOhm*km at 20° C. For instance, said insulating constant $k_i$ is greater than 0.3 MOhm*km at 70° C.

According to the present invention, in order to confer to the external insulating layer a suitable mechanical resistance without decreasing the flexibility of the cable, the expanded polymeric material of the external insulating layer is obtained from a polymeric material that, before expansion, has a flexural modulus at room temperature, measured according to ASTM standard D790-86, comprised between 20 MPa and 600 MPa. Preferably, said flexural modulus at room temperature is not greater than 200 MPa, more preferably it is comprised between 20 MPa and 200 MPa, even more preferably it is comprised between 10 MPa and 150 MPa.

Preferably, the external insulating layer 4 has a thickness comprised between 0.05 mm and 1.00 mm, more preferably between 0.10 mm and 0.50 mm.

Figure 2:
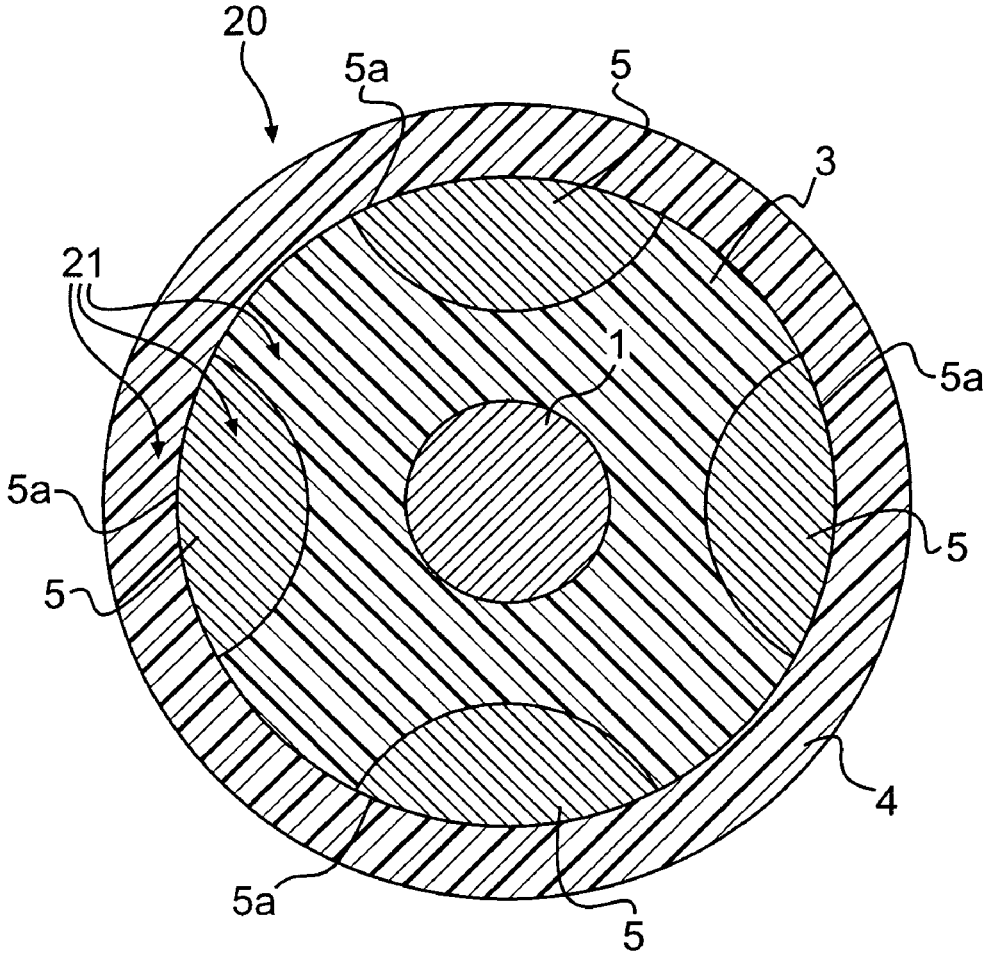
FIG. 2 shows a cross right section of an example of a further embodiment of a cable according to the present invention.

FIG. 2 shows the cross section of a further embodiment of a cable 20 for power transmission at low voltage according to the present invention.

Cable 20 is of the unipolar type and comprises a conductor 1 surrounded by a multilayer insulating coating 21. In details, according to said embodiment the insulating coating 21 comprises: an inner insulating layer 3 surrounding the conductor 1 and adhering thereto; an external insulating layer 4 coaxial with said inner insulating layer 3; and an intermediate insulating layer 5 which is interposed between said inner insulating layer 3 and said external insulating layer 4.

According to the embodiment shown in FIG. 2, the intermediate insulating layer 5 is circumferentially non-continuous in the cross section. Preferably, said intermediate insulating layer 5 presents at least one interruption. Even more preferably, said interruption is located along the external profile of the inner insulating layer 3. Alternatively, said interruption is located in proximity of the external profile of the inner insulating layer 3.

Preferably, said circumferentially non-continuous intermediate insulating layer 5 comprises at least one sector, i.e. a portion, which is substantially semicircular in shape (e.g. a portion which is lenticular in shape).

According to the embodiment shown in FIG. 2, the semicircular sectors are in the number of four and are obtained within the inner insulating layer 3.

Preferably, the ratio between: a) the sum of the lengths of the arcs 5*a* defined by said sectors on the circumference of the external insulating layer 4, and b) the circumference of the external insulating layer 4 itself, is greater than or equal to 0.5, more preferably greater than or equal to 0.7. Preferably, said ratio is lower than or equal to 1, more preferably lower than or equal to 0.9.

According to a further embodiment (not shown), the semicircular sectors are obtained within the external insulating layer 4.

The particular configuration shown in FIG. 2 can be advantageously employed to rapidly and easily perform the change of colour of the cable to be produced. Generally, a cable for building wiring is suitably coloured in order to simply distinguish one cable from another during installation and/or use. The manufacturing of a cable having the configuration shown in FIG. 2 is carried out by providing the extrusion apparatus with a flow control device which is able to modify the flow passage of the polymeric composition so that the polymeric material, which is used to form the external insulating layer, is successively used to form the intermediate insulating layer, and viceversa. In other words, said control device allows the flows of the polymeric materials of the external insulating layer and of the intermediate insulating layer to be exchanged so that the change of the cable colour can be performed easily and in a short length of the cable so that the scraps are remarkably reduced.

According to the embodiment of FIG. 2, the inner insulating layer 3 is non-expanded while the intermediate insulating layer 5 and the external insulating layer 4 are expanded.

Figure 3:
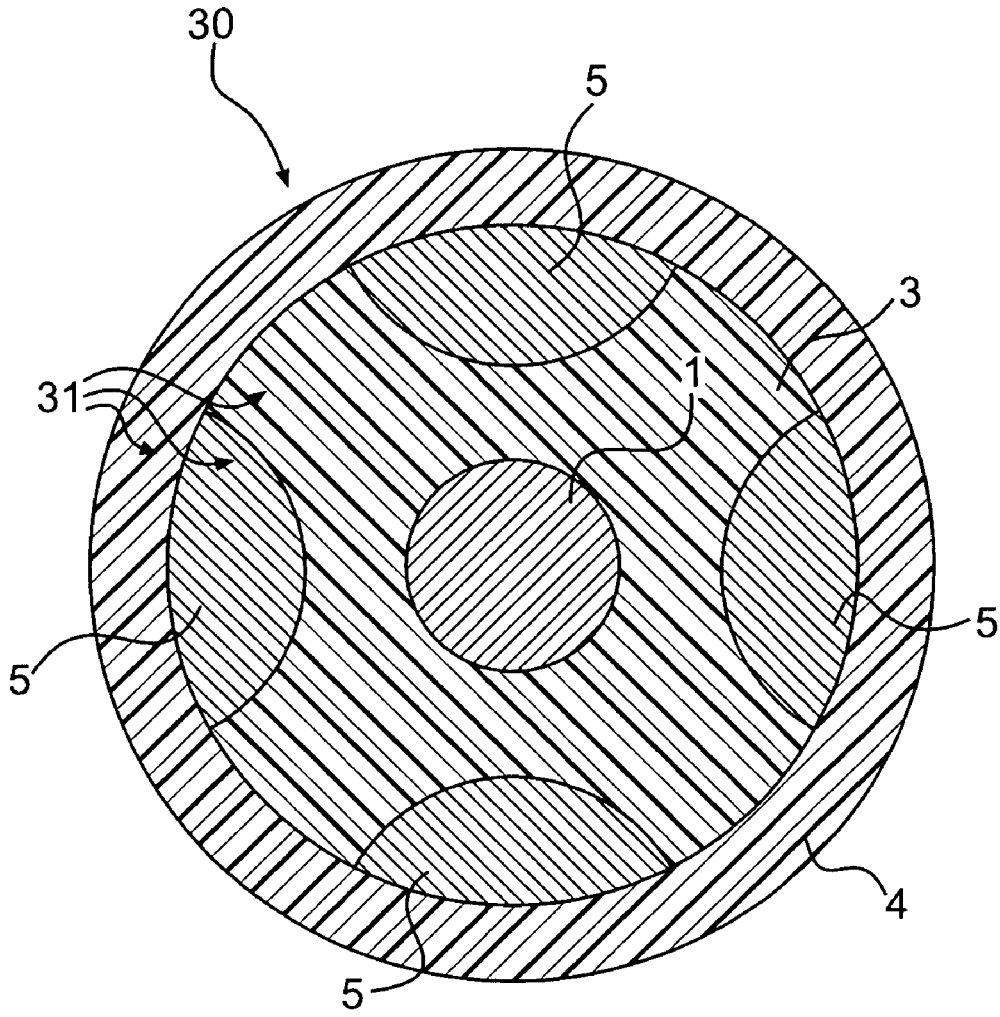
FIG. 3 shows a cross right section of an example of a further embodiment of the cable of FIG. 2.

FIG. 3 shows the cross section of a further embodiment of a cable 30 for power transmission at low voltage according to the present invention.

Cable 30 differs from cable 20 of FIG. 2 in that the external insulating layer 4 of the insulating coating 31 is non-expanded. In details, the insulating coating 31 comprises non-expanded inner and external insulating layers 3, 4 and an expanded intermediate insulating layer 5.

According to a further embodiment (not shown), the intermediate insulating layer is a layer which is circumferentially continuous, in the cross section. Preferably, said circumferentially continuous intermediate insulating layer uniformly surrounds the whole external profile of the inner insulating layer.

The figures illustrated above show only some of the possible embodiments of cables in which the present invention can be advantageously employed. Therefore, any suitable modifications can be made to the embodiments mentioned above such as, for example, the use of cables of the multipolar type or conductors of sectorial cross section.

With regard to the manufacturing process of a cable according to the present invention, the main steps characterizing the aforesaid process in the case when the unipolar cable of FIG. 1 has to be produced are presented in the following. However, the teaching given hereinbelow for the manufacturing of a unipolar cable can be used also in the case a multipolar cable has to be produced.

The conductor 1, unwound from a suitable reel, is introduced into an extrusion apparatus which is suitable for providing the conductor 1 with the insulating coating 2.

According to the embodiment of FIG. 1, the insulating coating 2 comprises an inner insulating layer 3 which is non-expanded and an external insulating layer 4 which is expanded.

The expansion of the polymeric base of said external insulating layer 4 is carried out during the extrusion step of the latter and can be effected either chemically or physically. In the first case, the expansion is effected by adding to the polymeric composition a suitable expanding agent which is able of evolving a gas under predetermined pressure and temperature conditions, i.e the pressure and temperature conditions of the extruder head. In the second case, the expansion is effected by injecting a gas at high pressure directly into the barrel of the extruder.

Preferably, according to the present invention, the insulating layers 3, 4 of the insulating coating 2 are applied by co-extrusion so that the expanded insulating layer 4 becomes integral with the non-expanded insulating layer 3, said layers becoming bonded together to form the cable insulating coating 2.

In the case the expansion is chemically effected, examples of suitable expanding agents are: azodicarbamide, paratoluene sulphonylhydrazide, mixtures of organic acids (e.g. citric acid) with carbonates and/or bicarbonates (e.g. sodium bicarbonate), and the like.

In the case the expansion is physically effected, examples of gases that can be injected at high pressure into the extruder barrel are: nitrogen, carbon dioxide, air, low-boiling hydrocarbons, e.g. propane or butane, halogenated hydrocarbons, e.g. methylene chloride, trichlorofluoromethane, 1-chloro-1,1-difluoroethane, and the like or their mixtures.

Preferably, the die of the extruder head has a diameter slightly lower than the final diameter of the cable with expanded covering that it has to be obtained, in such a way that expansion of the polymer outside the extruder results in attainment of the desired diameter.

It has been observed that, in the same extrusion conditions (such as rotary speed of the screw, speed of the extrusion line, diameter of the extruder head) one of the process variables having most influence on the expansion degree is the extrusion temperature. In general, a sufficient expansion degree can be obtained at temperatures greater than 130° C. The extrusion temperature is preferably at least 140° C., more preferably about 180° C. Normally, an increase in extrusion temperature corresponds to a higher expansion degree.

Furthermore, it is possible to control the expansion degree of the polymer to some extent by acting upon the cooling rate. In fact, by delaying or by suitably speeding up the cooling of the polymer forming the expanded covering as it leaves the extruder, it is possible to increase or decrease the expansion degree of said polymer. This can be made, for example, by varying the flow rate of a cooling fluid (e.g. water) in a cooler positioned downstream of the extruder head.

Furthermore, the expanded polymeric material of the cable insulating layer of the insulating coating can undergo a cross-linking process. Cross-linking is effected, after the steps of extrusion and expansion, according to known techniques, in particular by heating in the presence of a radical initiator, for example an organic peroxide such as dicumyl peroxide. Alternatively, cross-linking can be effected using silanes, i.e. by using a polymer belonging to the group mentioned above, in particular a polyolefin, to which are grafted, covalently, silane units comprising at least one hydrolysable group, for example trialkoxysilane groups, in particular trimethoxysilane. Grafting of the silane units to the polyolefin backbone can be made by a radical reaction with silane compounds, for example methyltriethoxysilane, dimethyldiethoxysilane, vinyldimethoxysilane, and the like. Cross-linking is effected in the presence of water and of a cross-linking catalyst, for example an organic titanate or a metallic carboxylate. Dibutyltin dilaurate (DBTL) is especially preferred.

For further description of the invention, some illustrative examples are given below.

EXAMPLE 1

A first polymeric mix was prepared suitable for making the inner insulating layer of a cable insulating coating.

The composition of said mix is shown in Table 1 (expressed in parts by weight per 100 parts by weight of base polymer, or phr).

Except for the plasticizing agent, the components of said first polymeric mix were firstly mixed in a closed mixer working at a constant temperature of about 120° C. and achieving a suitable vacuum degree (i.e., a maximum residual pressure of about 100 mmHg). Successively, e.g. 10 sec after the introduction of the mix components, the plasticizing agent was introduced into said mixer. The polymeric mix, discharged at a temperature of about 120° C., was cooled at a temperature of about 70° C. and fed into an extruder. Thus, the extrudate was successively submitted to a pelletizing operation.

TABLE 1

| | |
|---|---|
| PVC K70 Resin (e.g. Evipol SH7020 ® produced by EVC) | 100 |
| Antimony trioxide | 0.75 |
| Calcium carbonate | 60 |
| Bisphenol A | 0.62 |
| Stabilizing agent | 4 |
| Plasticizing agent | 38 |
| Mineral charge | 2.5 |

Some samples in the form of plates were obtained from the pellets mentioned above in order to carry out mechanical measures.

The flexural modulus of the polymeric material, before expansion, was measured at room temperature (20° C.) according to ASTM standard D790 and a value of 144 MPa was obtained.

Ultimate tensile stress was measured according to Standard IEC 60811 1-1 ($2^{nd}$ Edition, 1985) and a value of 16.8 MPa was obtained. According to said Standard, the ultimate tensile stress of an insulating compound is required to be not lower than 12.5 MPa, while the ultimate tensile stress of a sheathing compound is required to be not lower than 10 MPa.

Ultimate elongation was measured according to Standard IEC 60811 1-1 and a value of 250% was obtained.

EXAMPLE 2

A second polymeric mix was prepared suitable for making the external insulating layer of a cable insulating coating.

The composition of said mix is shown in Table 2 (expressed in parts by weight per 100 parts by weight of base polymer, or phr).

The components of said second polymeric mix were subjected to process steps analogous to those described in Example 1.

TABLE 2

| | |
|---|---|
| PVC K70 Resin (e.g. Evipol SH7020 ® produced by EVC) | 100 |
| Antimony trioxide | 3 |
| Calcium carbonate | 100 |
| Bisphenol A | 0.2 |
| Stabilizing agent | 8 |
| Plasticizing agent | 40 |
| Chlorinated paraffin | 18 |

Some samples in the form of plates were obtained from said pellets in order to carry out mechanical properties measures.

The flexural modulus of the polymeric material, before expansion, was measured at room temperature (20° C.) according to ASTM standard D790 and a value of 32.7 MPa was obtained.

Ultimate tensile stress was measured according to Standard IEC 60811 1-1 and a value of 14 MPa was obtained.

Ultimate elongation was measured according to Standard IEC 60811 1-1 and a value of 320% was obtained.

EXAMPLE 3

In order to obtain during the extrusion process the expansion of the external insulating layer, a master-batch of the second polymeric composition and of the expanding agent was prepared. The master-bach is reported in Table 3 hereinbelow (expressed in parts by weight-% wt).

TABLE 3

| | |
|---|---|
| Second polymeric composition | 60% wt |
| LAGOCELL20 ® (expanding agent) | 20% wt |
| LAGOCELLBO20 ® (expanding agent) | 20% wt |

LAGOCELL20® is azodicarbonamide, produce by Lagor S.p.A.

LAGOCELLBO20® is 4,4'-oxybis (benzenesulfonhydrazide, produced by Lagor S.p.A.

EXAMPLE 4

Production of a low-voltage cable was undertaken according to the cable design shown in FIG. 1.

The cable conductor 1 was made of copper and had a cross section of about 1.5 $mm^2$.

The cable conductor was provided with an insulating coating 2 consisting of an inner insulating layer 3 and an external insulating layer 4. The inner insulating layer 3 and the external insulating layer were obtained by co-extrusion providing the extrusion apparatus with a double layer extrusion head. The inner insulating layer was obtained by introducing the first polymeric composition reported in Table 1 into a 120 mm single-screw extruder in 25 D configuration, with rotary speed of the screw of about 20.3 rev/min. The external insulating layer was obtained by introducing the second polymeric composition reported in Table 2 together with 1.2% by weight of the master-batch reported in Table 3 and 1% by weight of colouring agent (Polyone 3050 BK30® produced by Polyone) into a 120 mm single-screw extruder in 25 D configuration, with rotary speed of the screw of about 45 rev/min.

The thickness of the inner insulating layer was about 0.6 mm. The thickness of the expanded external insulating layer was about 0.1 mm. Therefore, the overall thickness of the insulating coating was about 0.7 mm in accordance with Italian Standard CEI-UNEL 35752 (2nd Edition-February 1990).

The speed line was about 570 m/min and the cable diameter was comprised between 2.88 mm and 2.91 mm.

Tables 4 and 5 hereinbelow show the thermal profiles of the extruders of said insulating layers and of the extrusion head of the extrusion apparatus, the latter being devided into a plurality of zones identifying distinct portion of the extruder along its longitudinal axis.

TABLE 4

| Zone of the extruder of the inner insulating layer | Temperature (° C.) |
|---|---|
| Zone 1 | 125 |
| Zone 2 | 145 |
| Zone 3 | 145 |
| Zone 4 | 145 |
| Zone 5 | 145 |
| Neck | 140 |
| Die | 150 |

TABLE 5

| Zone of the extruder of the external insulating layer | Temperature (° C.) |
|---|---|
| Zone 1 | 130 |
| Zone 2 | 150 |
| Zone 3 | 160 |
| Zone 4 | 155 |
| Neck | 150 |
| Die | 150 |

The material of the insulating coating had a final density of 1.43 kg/l and a expansion degree of 5%. The expansion degree of the external insulating layer alone was of about 30%.

The cable was successively cooled in water and finally wound on a storage reel.

Mechanical Properties

A sample of the cable produced according to the procedure described in Example 4 was tested in order to measure the most relevant mechanical properties of the cable.

The ultimate tensile stress, measured according to Standard IEC 60811 1-1 mentioned above, was of about 15 MPa, while the ultimate elongation, measured according to the Standard mentioned above, was of about of 205%.

From a manual handling of the cable sample, the Applicant has detected that the flexibility thereof was sensibly improved.

Electrical Properties

The insulating constant $k_i$ was measured according to Italian Standard CEI 20-11 mentioned above and values of about 750 MOhm*km at 20° C. and of about 0.7 MOhm*km at 70° C. were obtained.

Peeling-off Property

A sample of the cable was tested by measuring the load (KN) necessary for extracting the insulating coating from the conductor.

The test was carried out as follows. A cable sample of about 180 mm in length was provided so that a first end portion of the cable of about 50 mm in length and a second end portion of the cable of about 80 mm in length were prepared devoid of the insulating coating. Therefore, the cable consisted of an insulated central portion of about 50 mm in length and of first and second end portions made of the conductor only. A cylinder, provided with a longitudinal hole of a diameter corresponding to the external diameter of the insulated cable, was employed in order to contain the cable sample. In details, the cable sample was inserted into the longitudinal hole of the cylinder so that the whole first end portion of the cable came out from the cylinder while the central portion and the second end portion of the cable were positioned inside the cylinder. Since the external diameter of the insulated portion of the cable was substantially equal to the diameter of the hole of the cylinder, the latter was maintained in this position thanks to the friction action between the walls of the hole and the insulated portion of the cable. A dynamometer was used to carry out the test, said dynamometer being provided with upper and lower clamps. In details, the dynamometer fixing upper clamps were associated to the cable conductor of the first end portion while the dynamometer movable fixing lower clamps were associated to the lower end of the cylinder so that the latter could be moved downwardly (i.e. in the direction of the longitudinal hole). The test was stopped when the cylinder was displaced downwardly of a length equal to the length of the cable insulated portion (i.e., about 50 mm) and the force necessary to obtain said displacement (i.e., the force necessary to remove the insulating coating from the conductor) was measured. The measured value was of about 0.025 KN.

Marking Property

A sample of the cable was marked by embossing when the cable came out from the extrusion head, i.e. when the cable was not cooled yet.

In order to evaluate the quality of the marking, the sample was inspected by means of a reflection microscope and a height of about 40 μm of the marked letters was measured.

EXAMPLE 5 (COMPARATIVE)

Production of a low-voltage cable similar to that of Example 4 was undertaken, the only difference being that the external insulating layer of the cable was non-expanded. Therefore, the external insulating layer was obtained by introducing into the corresponding extruder only the polymeric composition reported in Table 2 (no master-batch was needed since no expanding agent was required).

The working conditions of the cable manufacturing process were identical to those described in Example 4.

Mechanical Properties

A sample of the cable was tested in order to measure the most relevant mechanical properties of the cable.

The ultimate tensile stress, measured according to Standard IEC 60811 1-1 mentioned above, was of about 16 MPa, while the ultimate elongation, measured according to the Standard mentioned above, was of about of 205%.

Electrical Properties

The insulating constant $k_i$ was measured according to Italian Standard CEI 20-11 mentioned above and values of about 800 MOhm*km at 20° C. and of about 0.7 MOhm*km at 70° C. were obtained.

Peeling-off Property

A sample of the cable was tested analogously to the procedure described in Example 4.

The measured value was of about 0.045 KN.

Marking Property

A sample of the cable was marked by embossing according to the procedure described in Example 4.

The height of the marked letters was of about 20 μm.

The invention claimed is:

1. An electric cable comprising a conductor and an insulating coating surrounding said conductor, said insulating coating having a predetermined thickness and comprising at least two insulating layers, said insulating layers, in a radial direction from the inside toward the outside of said electrical cable, comprising:

a. at least one insulating layer made of a non-expanded polymeric material and b. at least one insulating layer made of an expanded polymeric material, said at least one insulating layer made of an expanded polymeric material being integral with said at least one insulating layer made of a non-expanded polymeric material;

wherein said expanded polymeric material is obtained from a polymeric material that, before expansion, has a flexural modulus at room temperature, measured according to ASTM Standard D790, not greater than 200 MPa.

2. The electric cable according to claim 1, wherein the thickness of said at least one insulating layer made of a non-expanded polymeric material is at least half of said predetermined thickness of said insulating coating.

3. The electric cable according to claim 2, wherein the thickness of said at least one insulating layer made of a non-expanded polymeric material is not lower than 70% of said predetermined thickness of said insulating coating.

4. The electric cable according to claim 3, wherein the thickness of said at least one insulating layer made of a non-expanded polymeric material is not lower than 85% of said predetermined thickness of said insulating coating.

5. The electric cable according to claim 1, wherein said at least one insulating layer made of an expanded polymeric material is bonded with said at least one insulating layer made of a non-expanded polymeric material.

6. The electric cable according to claim 1, wherein said at least one insulating layer made of an expanded polymeric material is co-extruded with said at least one insulating layer made of a non-expanded polymeric material.

7. The electric cable according to claim 1, wherein said at least one insulating layer made a non-expanded polymeric material adheres to said at least one conductor.

8. The electric cable according to claim 1, wherein said at least one insulating layer made of an expanded polymeric material of said insulating coating is an intermediate layer between an inner insulating layer made of a non-expanded polymeric material and an external insulating layer made of an expanded polymeric material.

9. The electric cable according to claim 1, wherein said at least one insulating layer made of an expanded polymeric material of said insulating coating is an intermediate layer between an inner insulating layer made of a non-expanded polymeric material and an external insulating layer made of a non-expanded polymeric material.

10. The electric cable according to claim 8 or 9, wherein said intermediate insulating layer is circumferentially non-continuous in the cross-section.

11. The electric cable according to claim 10, wherein said intermediate insulating layer presents at least one interruption.

12. The electric cable according to claim 11, wherein said at least one interruption is located along the external profile of said inner insulating layer.

13. The electric cable according to claim 11, wherein said at least one interruption is located in proximity of the external profile of said inner insulating layer.

14. The electric cable according to claim 10, wherein said circumferentially non-continuous intermediate insulating layer comprises at least one semicircular sector.

15. The electric cable according to claim 14, wherein said at least one semicircular sector is provided within said inner insulating layer.

16. The electric cable according to claim 14, wherein said at least one semicircular sector is provided within said external insulating layer.

17. The electric cable according to claim 8 or 9, wherein said intermediate insulating layer is circumferentially continuous in the cross-section.

18. The electric cable according to claim 1, wherein said flexural modulus is between 20 MPa and 200 MPa.

19. The electric cable according to claim 18, wherein said flexural modulus is between 10 MPa and 150 MPa.

20. The electric cable according to claim 1, wherein the polymeric material of said at least one insulating layer is an expandable polymer selected from the group comprising: polyolefins, copolymers of various olefins, olefins/unsaturated esters eopolymers, polyesters, and their mixtures.

21. The electric cable according to claim 20, wherein said expandable polymer is polyvinyl chloride.

22. The electric cable according to claim 1, wherein said at least one insulating layer made of a non-expanded polymeric material and said at least one insulating layer made of an expanded polymeric material are made of the same base polymeric material.

23. The electric cable according to claim 1, wherein said at least one insulating layer made of an expanded polymeric material has an expansion degree between 2% and 500%.

24. The electric cable according to claim 23, wherein said expansion degree is between 5% and 200%.

25. The electric cable according to claim 24, wherein said expansion degree is between 10% and 50%.

26. The electric cable according to claim 1, wherein said at least two insulating layers of said insulating coating present an insulating constant (ki) greater than 750 MOhm*km at 20°C.

27. The electric cable according to claim 1, wherein said at least two insulating layers of said insulating coating present an insulating constant (ks) greater than 0.3 MOhm*km at 70°C.

28. The electric cable according to claim 1, wherein said at least one insulating layer made of an expanded polymeric material has a thickness between 0.05 mm and 1.00 mm.

29. The electric cable according to claim 28, wherein the thickness of said at least one insulating layer made of an expanded polymeric material is between 0.10 mm and 0.50 mm.

30. A process for manufacturing an electric cable, said cable comprising a conductor and an insulating coating surrounding said conductor and comprising, in a radial direction from the inside toward the outside of said electrical cable, at least one insulating layer made of a non-expanded polymeric material and at least one insulating layer made of an expanded polymeric material, comprising the steps of:

feeding said conductor to an extruding machine;

depositing by co-extrusion:

a non-expandable polymeric material in a position radially external to said conductor so as to form said at least one insulating layer made of a non-expanded polymeric material; and an expandable polymeric material in a position radially external to said at least one insulating layer made of a non-expanded polymeric material so as to form said at least one insulating layer made of an expanded polymeric material; and expanding said expandable polymeric material during said step of depositing by co-extrusion;

wherein said expandable polymeric material is obtained from a polymeric material that, before expansion, has a flexural modulus at room temperature, measured according to ASTM Standard D790, not greater than 200 MPa.

31. The process according to claim 30, wherein said step of expanding is effected during said step of depositing by co-extrusion by adding an expanding agent.

32. The process according to claim 31, wherein said step of expanding is effected during said step of depositing by co-extrusion by injecting a gas at a high pressure.

* * * * *

UNITED STATES PATENT AND TRADEMARK OFFICE

CERTIFICATE OF CORRECTION

PATENT NO. : 7,105,749 B2
APPLICATION NO. : 10/511204
DATED : September 12, 2006
INVENTOR(S) : Sergio Belli et al.

It is certified that error appears in the above-identified patent and that said Letters Patent is hereby corrected as shown below:

Claim 20, column 16, line 22, "eopolymers," should read --copolymers,--.

Claim 26, column 16, line 39, "(ki)" should read --($k_i$)--.

Claim 27, column 16, line 43, "(ks)" should read --($k_i$)--.

Signed and Sealed this

Sixth Day of March, 2007

JON W. DUDAS
*Director of the United States Patent and Trademark Office*